US007103293B2

(12) United States Patent
Yamaguchi

(10) Patent No.: US 7,103,293 B2
(45) Date of Patent: Sep. 5, 2006

(54) FIXING UNIT WITH COOLING SECTION AND IMAGE FORMING APPARATUS WITH COOLING SECTION

(75) Inventor: Yasunaga Yamaguchi, Tokyo (JP)
(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/974,823

(22) Filed: Oct. 28, 2004

(65) Prior Publication Data

US 2005/0111864 A1 May 26, 2005

(30) Foreign Application Priority Data

Nov. 25, 2003 (JP) ..... 2003-393575

(51) Int. Cl.
*G03G 15/20* (2006.01)

(52) U.S. Cl. ..... 399/33; 399/69; 219/216

(58) Field of Classification Search ..... 399/33, 399/44, 69, 92, 94; 219/216
See application file for complete search history.

(56) References Cited

U.S. PATENT DOCUMENTS 6,072,397 A * 6/2000 Ostrowski ..... 340/588
2003/0118363 A1* 6/2003 Izawa et al. ..... 399/69
2005/0201056 A1* 9/2005 Lin ..... 361/695

* cited by examiner

*Primary Examiner*—Robert Beatty
(74) *Attorney, Agent, or Firm*—Takeuchi & Kubotera, LLP

(57) ABSTRACT

A heating section (1) heats a fixing roller (10). A cooling section (2) cools the interior of a unit or apparatus. A temperature detecting section (3) detects the temperature of the fixing roller (10). A control section (4) controls current conduction to the heating section (1) based on the detected temperature. A conduction cutoff section (5) cuts off current conduction to the heating and cooling sections (1, 2) regardless of conduction control by the control section (4) if the detected temperature exceeds a predetermined temperature.

22 Claims, 10 Drawing Sheets

FIXING UNIT WITH COOLING SECTION AND IMAGE FORMING APPARATUS WITH COOLING SECTION

BACKGROUND OF THE INVENTION

1. Field of the Invention

The present invention relates to a fixing unit with a cooling section for an eleotrophotographic apparatus, and an image forming apparatus with a cooling section.

2. Description of the Related Art

An image forming apparatus, such as an electrophotographic apparatus, includes a fixing unit for fixing the toner image onto a print medium. The fixing roller of the fixing unit is heated up to a high temperature and the surface temperature is controlled to stay within a predetermined range.

FIG. 8 shows a temperature control circuit of a conventional fixing unit. The conventional fixing unit includes a heating section 1 for heating a fixing roller 10, a cooling section 2 for blowing air into the interior of the unit to cool the fixing roller 10, a temperature detection section 3 for detecting the surface temperature of the fixing roller 10, and a control section 4 for sending a control signal to the heating section 1 to heat the fixing roller if the detected temperature of the fixing roller 10 is below a predetermined temperature or to stop heating the fixing roller 10 if the detected temperature is above the predetermined temperature.

The heating section 1 includes a series circuit of a heater 1-1 for heating the fixing roller 10, a thermostat 1-2 for preventing overheat of the fixing roller 10 due to a malfunction, an a-c current source 1-3 for supplying the heater 1-1 with heating current, and a switching circuit 1-4 for turning on/off the a-c current source 1-3 based on control of the control section 4. An amplifier consisting of a transistor Tr1, a resistor R3, and a resistor R8 to receive and amplify a control signal from the control section 4 is connected to a control terminal of the switching circuit 1-4.

The cooling section 2 includes a fan 2-1 for cooling the unit interior, an amplifier consisting of a transistor Tr4, a resistor R9, and a resistor R10 for amplifying a control signal from the control section 4, and a driving amplifier consisting of a transistor Tr5 and a resistor 11 for driving the fan 2-1. The temperature detection section 3 includes a thermistor 3-1 for detecting the temperature of a fixing roller 10 and a voltage dividing resistor R1. The voltage at a connection point between the thermistor 3-1 and the voltage dividing resistor R1 is sent to a port P1 of the control section 4 as the detected temperature.

The control section 4 is made of a central processing unit (CPU) and connected to a read only memory (ROM) and a random access memory (RAM). According to a readable program stored in the ROM or RAM, it receives the detected temperature from the temperature detection section 3 and executes a predetermined process, sending a control signal to the heating section 1.

In the above conventional fixing unit, if the control section 4 becomes out of control or the switching circuit 1-4 is down, an unexpected heating current can be continuously supplied to the heater 1-1 to raise the temperature of the fixing roller above the necessary level. If the fan 2-1 keeps rotating under this condition, the raised temperature spreads over the entire equipment, preventing normal printing. There is a technique that the sensitivity of the thermostat 1-2 is enhanced to prevent the extreme increase in the temperature of a fixing roller.

In the conventional fixing unit, however, it is impossible to prevent the raised temperature from spreading over the entire unit, causing a malfunction. In addition, there is a limit to the improvement in the thermostat and it is difficult to completely prevent the continuous supply of unexpected current to the heater 1-1.

SUMMARY OF THE INVENTION

Accordingly, it is an object of the invention to provide a fixing unit capable of preventing the raised temperature from spreading over the entire unit when the control section becomes out of control or the switching circuit is down.

According to the invention, current conduction to the heater and/or the fan is cutoff regardless of operation of the thermostat and control of the heater and the fan by the control section if the temperature of the fixing roller detected by the thermistor exceeds a predetermined protective temperature.

When the detected temperature exceeds the predetermined temperature, current conduction to the heater and the fan is cutoff regardless of operation of the thermostat and control of the heater and fan by the control section to prevent heating current to the heater and the raised temperature from spreading over the entire unit.

DESCRIPTION OF THE PREFERRED EMBODIMENTS

Figure 1:
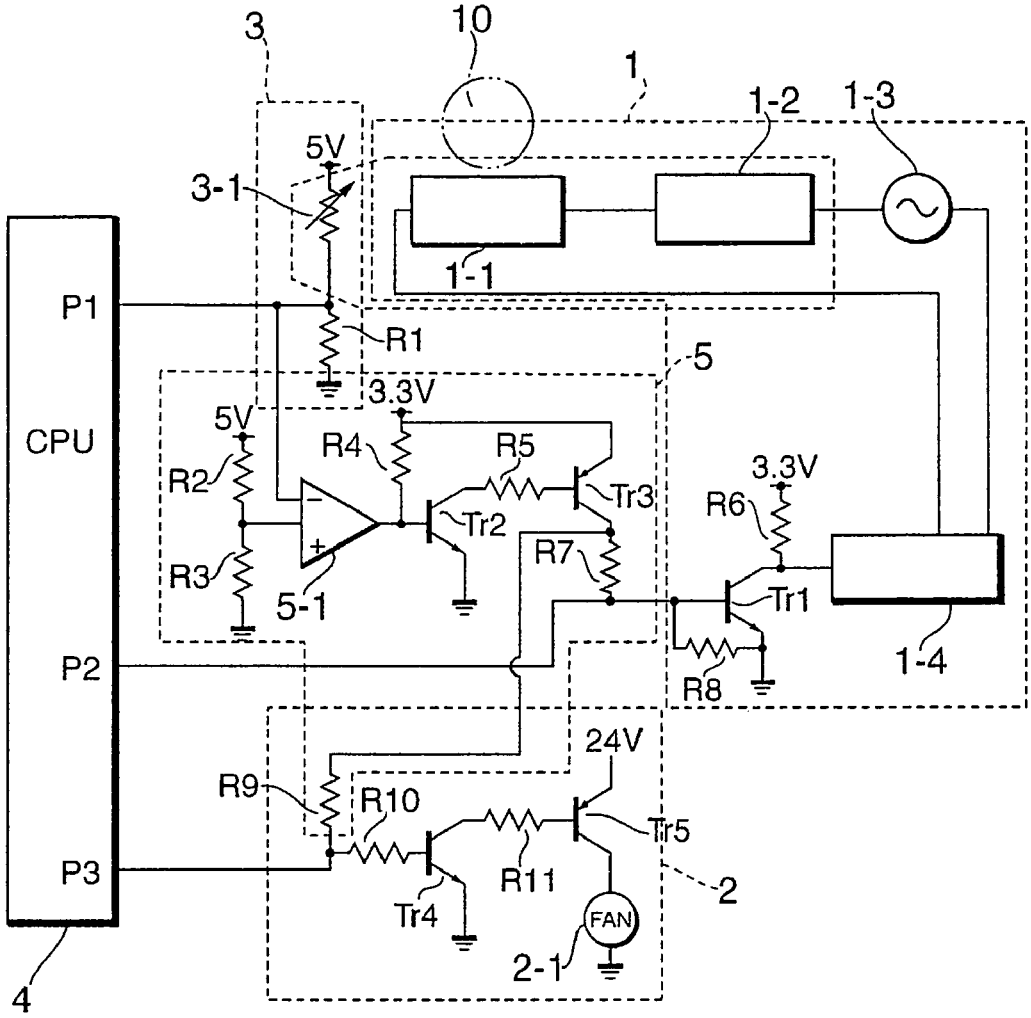
FIG. 1 is a circuit diagram of a fixing unit according to the first embodiment of the invention.

In FIG. 1, a fixing unit includes a heating section 1, a cooling section 2, a temperature detection section 3, a control section 4, and a conduction cut-off section 5.

The heating section 1 heats a heat member (hereinafter "fixing roller") and includes a heater 1-1 for heating the fixing roller, a thermostat 1-2 for preventing overheat of the fixing roller 10 upon malfunction, an a-c current source 1-3, a switching circuit 1-4 for turning on/off the a-c current source 1-3 based on control of the control section 4, and an amplifier consisting of a transistor Tr1 and resistors R6 and R8 for receiving a control signal from the control section 4.

One end of the a-c current source 1-3 is connected to an end of the heater 1-1 via the thermostat 1-2. The other end of the heater 1-1 is connected to the switching circuit 1-4 to which the other end of the a-c current source 1-3 and the collector of the transistor Tr1 are connected. The emitter and base of the transistor Tr1 are connected to the ground and the port P2 of the control section 4, respectively, and the collector is connected to 3.3 Vd-c via the resistor R6. The resistor R8 is connected between the emitter and the base.

The cooling section 2 includes a fan 2-1 for cooling the unit interior, an amplifier consisting of a transistor Tr4 and resistors R9 and R10 for amplifying a control signal from the control section 4, and a driving amplifier consisting of a transistor Tr5 and a resistor R11 for driving the fan 2-1 to blow air into the unit interior to cool the fixing roller 10. The base of the transistor Tr4 is connected to a port P3 of the control section 4 via the resistor R10. The emitter of the transistor Tr4 is connected to the ground and the collector is connected to the base of the transistor Tr5 via the resistor R11. The emitter and collector of the transistor Tr5 are connected to 24 Vd-c and an end of the fan 2-1, respectively. The other end of the fan 2-1 is grounded. The resistor R10 is connected to the conduction cut-off section 5.

The temperature detection section 3 includes a thermistor 3-1 for detecting the temperature of the fixing roller 10 and the voltage dividing resistor R1 to detect the surface temperature of the fixing roller 10. The voltage at the connection point between the thermistor 3-1 and the dividing resistor R1 is sent to the port P1 of the control section 4 as the detected temperature by the temperature detecting section 3. An end of the thermistor 3-1 is connected to 5 Vd-c and the other end is grounded via the voltage dividing resistor R1. The connection point between the thermistor 3-1 and the voltage dividing resistor R1 is connected to not only the port P1 but also the negative terminal of a comparator 5-1.

The control section 4 is made of a CPU connected to a ROM and a RAM. According to a readable program stored in the ROM or RAM, it receives a detected temperature from the temperature detecting section 3 and executes a predetermined process. If the fixing roller 10 is below a predetermined temperature, it sends a control signal to the heating section 1 for heating the fixing roller 10 and, if the fixing roller 10 is above a predetermined temperature, it sends a control signal to stop heating the fixing roller 10. The ports P1, P2, and P3 are connected to the connection point between the thermistor 3-1 and the voltage dividing resistor R1, the base of the transistor Tr1, and the base of the transistor Tr4 via the resistor R10, respectively.

The conduction cut-off section 5 cuts off current conduction to both the heating section 1 and the cooling section 2 if the temperature detected by the temperature detecting section 3 exceeds a predetermined temperature (protecting temperature). It includes a pulse forming circuit consisting of voltage dividing resistors R2 and R3, the comparator 5-1, transistors Tr2 and Tr3, and resistors R4, R5, and R7.

As shown in the figure, the protecting voltage is inputted to the positive terminal of the comparator 5-1 to prevent an abnormal rise of the temperature of the fixing roller 10. The protecting voltage is set by the voltage dividing ratio of the voltage dividing resistors R2 and R3 based on the protective temperature. The output terminal of the comparator 5-1 is connected to both the base of the transistor Tr2 and 3.3 Vd-c via the resistor R4. The emitter and collector of the transistor Tr2 are connected to the ground and the base of the transistor Tr3 via the transistor R5, respectively. The emitter and collector of the transistor Tr3 are connected to 3.3 Vd-c and the base of the transistor Tr1 via the resistor R7, respectively. The connector of the transistor Tr3 is connected to both the port P3 of the control section 4 via the resistor R9 and the resistor R10.

Figure 2:
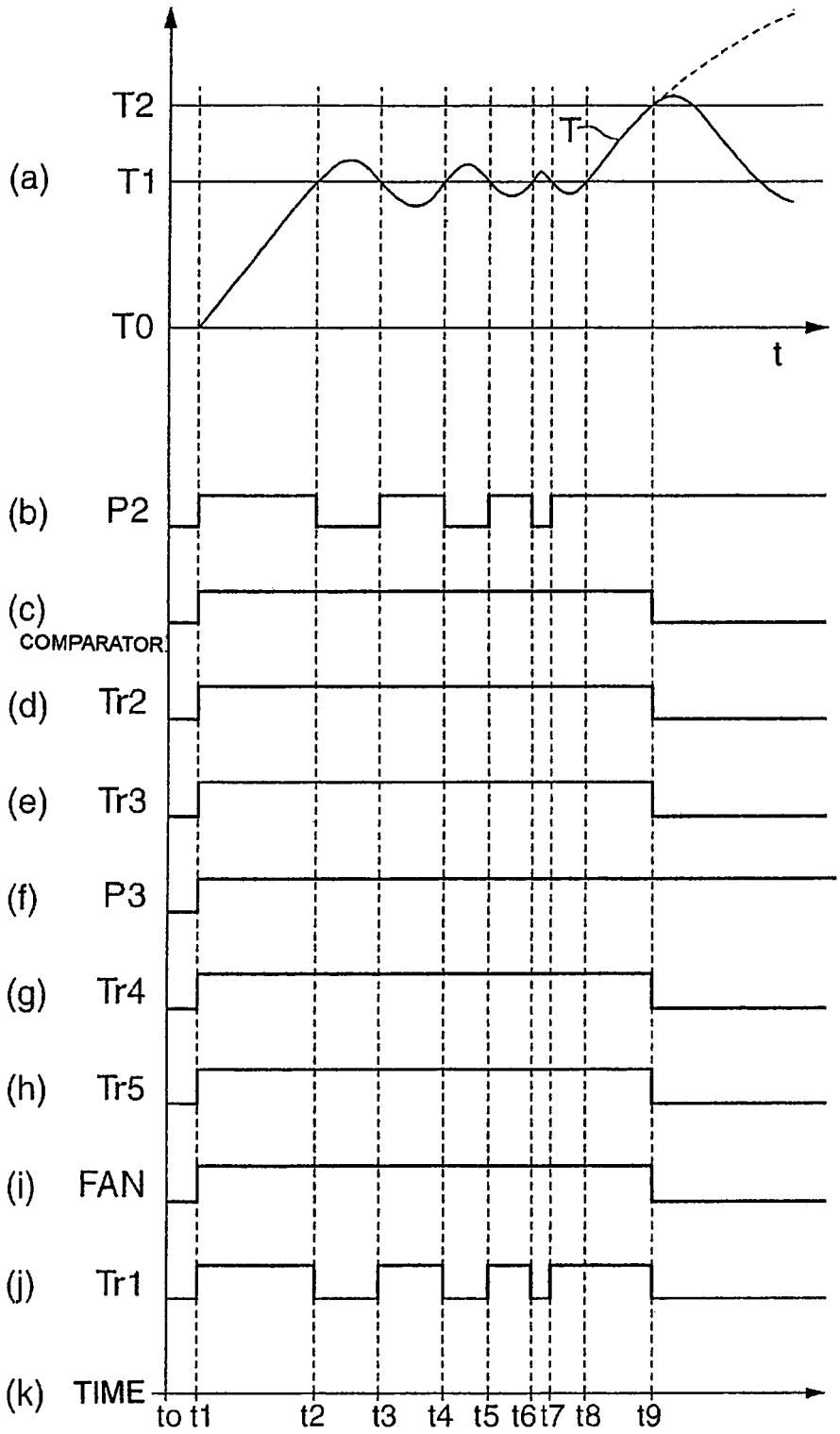
FIG. 2 is a temperature control time chart by the fixing unit.

In FIG. 2, (a) is the detected temperature of the thermistor 3-1 (FIG. 1) or the input to the port P1 (FIG. 1), (b) is the output at the port P2 (FIG. 1), (c) is the output of the comparator 5-1 (FIG. 1), (d) is the on/off of the transistor Tr2, (e) is the on/off of the transistor Tr3 (FIG. 1), (f) is the output at the port P3 (FIG. 1), (g) is the on/off of the transistor Tr4 (FIG. 1), (h) is the on/off of the transistor Tr 5 (FIG. 1), (i) is the rotation/stop of the fan 2-1 (FIG. 1), (j) is the on/off of the transistor Tr1 (FIG. 1), and (k) is the time common to all the items.

At a time t1, printing is started and the temperature control of the fixing unit is started. It is assumed that the initial value T0 of the detected temperature for the thermistor 3-1 is lower than the optimum fixing temperature T1. Consequently, the voltage (corresponding to the initial value T0) at the contact point between the thermistor 3-1 and the voltage dividing resistor R1 is lower than the voltage (corresponding to the protective temperature T2) at the contact point between the voltage dividing resistors R2 and R3 so that the output of the comparator 5-1 is on as shown in (c), turning on the transistors Tr2 and Tr3 as shown in (d, e). Consequently, the transistors Tr1 and Tr4 are normally biased by the resistors R7 and R9 for operation.

The control section 4, which has determined that the initial value TO at the port P1 is lower than the optimum fixing temperature T1, turns on the port P2 (high level) to raise the temperature of the fixing roller 10 (b). This action corresponds to sending a control signal to the switching circuit 1-4. Consequently, the transistor Tr 1 is turned on (j), conducting heating current in a loop consisting of the switching circuit 1-4, the heater 1-1, the thermostat 1-2 and the a-c current source 1-3 so that the surface temperature of the fixing roller starts to rise (a). At the same time, the control section 4 turns on the port P3 to rotate the fan 2-1 (f).

At a time t2, the surface temperature of the fixing roller 10 exceeds the optimum fixing temperature T1. The control section 4, which has determines that the detected temperature T from the port P1 is higher than the optimum fixing temperature T1, turns off the port P2 to lower the temperature of the fixing roller 10 (b). This action corresponds to sending a control signal to the switching circuit 1-4. Consequently, the transistor Tr1 is turned off (j), cutting off the loop consisting of the switching circuit 1-4, the heater 1-1, the thermostat 1-2, and the a-c current source 1-3 to bring the heating current to 0 so that the surface temperature of the fixing roller 10 starts to fall (a). At this point, however, the detected temperature T does not exceed the protective temperature T2 so that the items other than the port P2 (b) and the transistor Tr1 (j) keep the conditions at t1.

At a time t3, the surface temperature of the fixing roller 10 falls below the optimum fixing temperature T1. The control section 4, which has determines that the detected temperature T from the port P1 is lower than the optimum fixing temperature T1, turns on the port P2 to raise the temperature of the fixing roller 10 (b). This action corresponds to sending a control signal to the switching circuit 1-4. Consequently, the transistor Tr1 is turned on (j), conducting heating current in the loop consisting of the switching circuit 1-4, the heater 1-1, the thermostat 1-2, and the a-c source 1-3 so that the surface temperature of the fixing roller starts to rise (a).

At a time t8, the surface temperature of the fixing roller 10 exceeds the optimum fixing temperature T1. Consequently, the control section 4, which has determined that the detected temperature T from the port P1 is higher than the optimum fixing temperature T1, is supposed to turn off the port P2 to lower the temperature of the fixing roller 10. However, it is assumed that a failure of the control section 4 or the switching circuit 1-4 keeps the on conditions (b). Consequently, the heating current continues to run, raising the surface temperature of the fixing roller 10 above the protective temperature T2 at a time t9.

When the surface temperature of the fixing roller 10 exceeds the protective temperature T2, the voltage at the contact point of the thermistor 3-1 and the voltage dividing resistor R1 is higher than the protective voltage (corresponding to the protective temperature T2) at the contact point between the voltage dividing resistors R2 and R3, turning off the output of the comparator 5-1 (b), which in turn turns off the transistors Tr2 and Tr3 (d, e). Consequently, the transistors Tr1 and Tr4 are turned off by the resistors R7 and R9. Consequently, no matter what the outputs of the ports P2 and P3 are, the heating current becomes 0 and the fan 2-1 is stopped.

As has been described above, when the fixing roller 10 is heated up above the protective temperature T2, supply of the heating current to the heater 1-1 is stopped regardless of control by the control section 4. Thus, even if the control section 4 becomes out of control or the switching circuit is broken down, there is no danger that unexpected heating current is continuously supplied to the heater to raise the temperature of the fixing roller above the necessary temperature or the raised temperature spreads over the unit, causing a malfunction.

Second Embodiment

Figure 3:
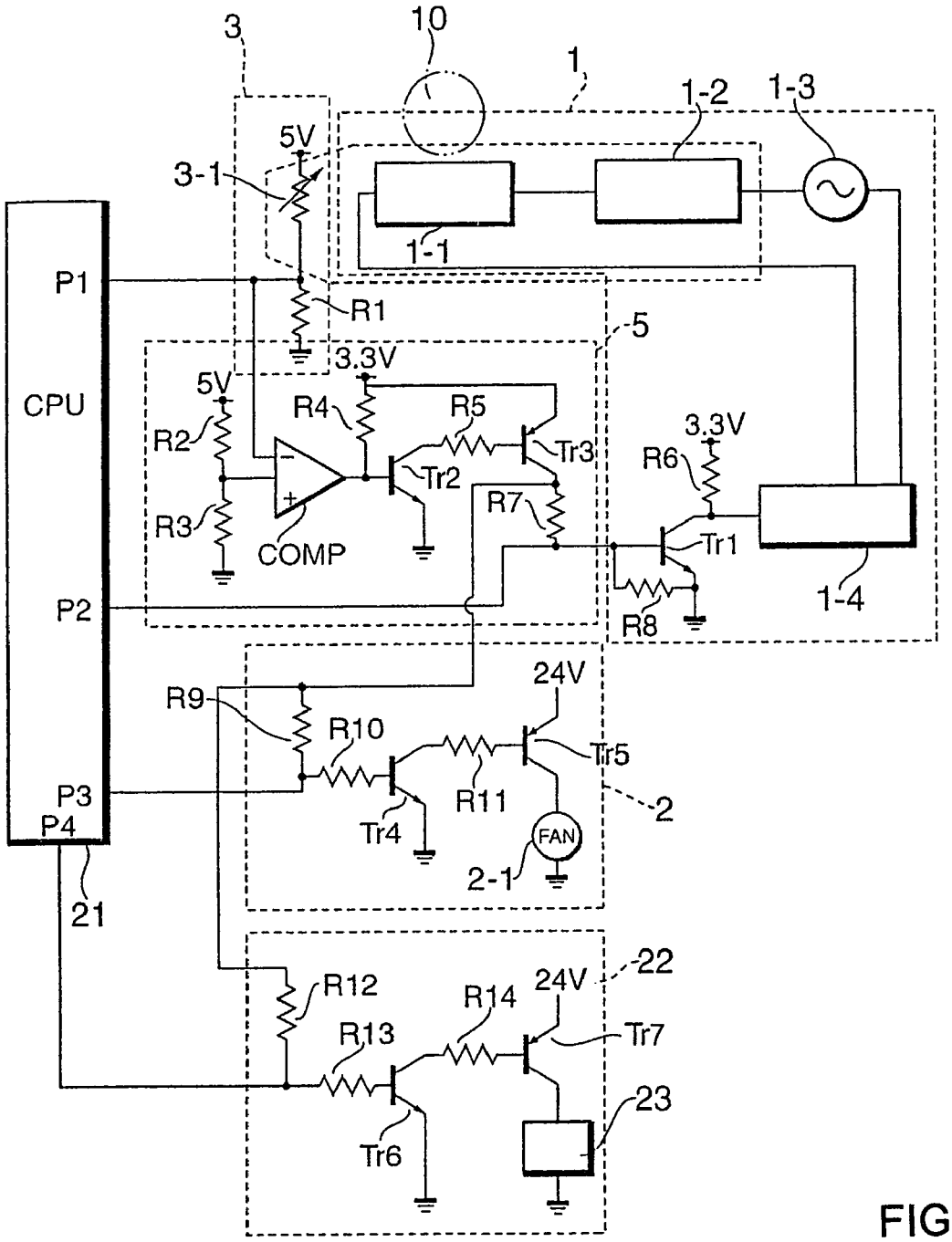
FIG. 3 is a circuit diagram of a fixing unit according to the second embodiment of the invention.

In FIG. 3, the temperature control circuit for the fixing unit which includes the heating section 1, the cooling section 2, the temperature detection section 3, the conduction cutoff section 5, a control section 21, and a shutter driving section 22. Only those different from the first embodiment will be described and the components identical with those of the first embodiment are given the same reference numbers as those of the first embodiment.

The control section 21 is made of a central processing unit (CPU) and connected to a read only memory (ROM) and a random access memory (RAM). According to the program read from the ROM or RAM, it receives a detected temperature from the temperature detection section 3, performs a predetermined process, and sends a control signal to the heating section 1 to heat the fixing roller 10 if the fixing roller 10 is below a predetermined temperature and to stop heating of the fixing roller 10 if the fixing roller 10 is above the predetermined temperature. Simultaneously, it sends a control signal to the shutter driving section 22 to keep a hereinafter described air path shutter 23 closed.

The port P1 is connected to the connection point between the thermistor 3-1 and the voltage dividing resistor R1. The port P2 is connected to the base of the transistor Tr1. The port P3 is connected to the base of the transistor Tr4 via the resistor R10. The port P4 is connected to the base of a transistor Tr6 via a resistor R13.

The shutter driving section 22 closes the unit if the temperature inside the unit rises extremely high to prevent damage to the unit. It includes an air path shutter 23, an amplifier consisting of the transistor Tr6, a resistor R12, and a resistor R13 to amplify the control signal from the control section 21, and a driver amplifier consisting of a transistor Tr7 and a resistor R14 to drive the air path shutter 23.

The port P4 of the control section 21 is connected to the base of the transistor Tr6 via the resistor R13. The emitter of the transistor Tr6 is grounded and the collector is connected to the base of the transistor Tr7 via a resistor R14. The emitter of the transistor Tr7 is connected to 24 Vd-c and the collector is connected to an end of the air path shutter 23. The other end of the air path shutter 23 is grounded. An end of the resistor R12 is connected to the conduction cutoff section 5. An example of-the air path shutter 23 will be described below.

Figure 4:
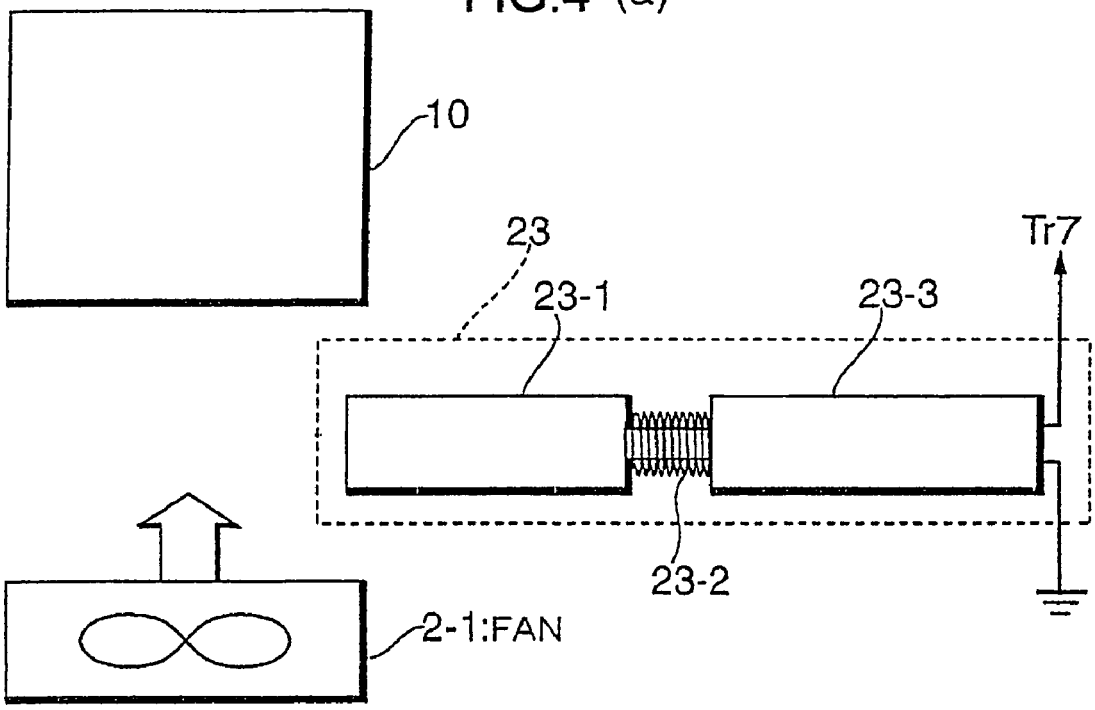
FIGS. 4(*a*) and 4(*b*) are schematic diagrams of an air path shutting section according to the second embodiment.
Figure 4:
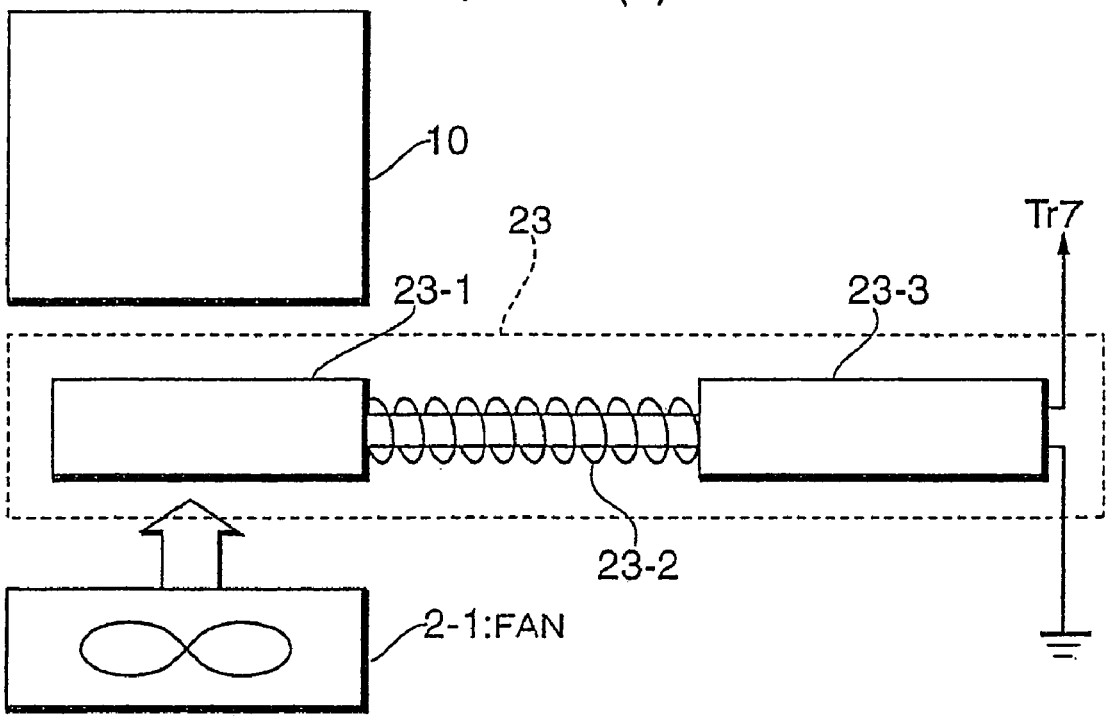

FIGS. 4(*a*) and 4(*b*) show the air path shutter 23 for opening and closing the air path between the fixing roller 10 and the fan 2-1, respectively. The air path shutter 23 includes a shutter member 23-1, a spring 23-2, and a solenoid 23-3.

When the fixing roller 10 operates at a normal temperature, the shutter member 23-1 is attracted by the solenoid 23-3, keeping the spring 23-3 compressed. Under this condition, the air path from the fan 2-1 to the fixing roller 10 is opened. If the fixing roller 10 reaches an abnormally high temperature, the shutter member 23-1 is pushed by the spring 23-2 to close the air path from the fan 2-1 to the fixing roller 10.

Figure 5:
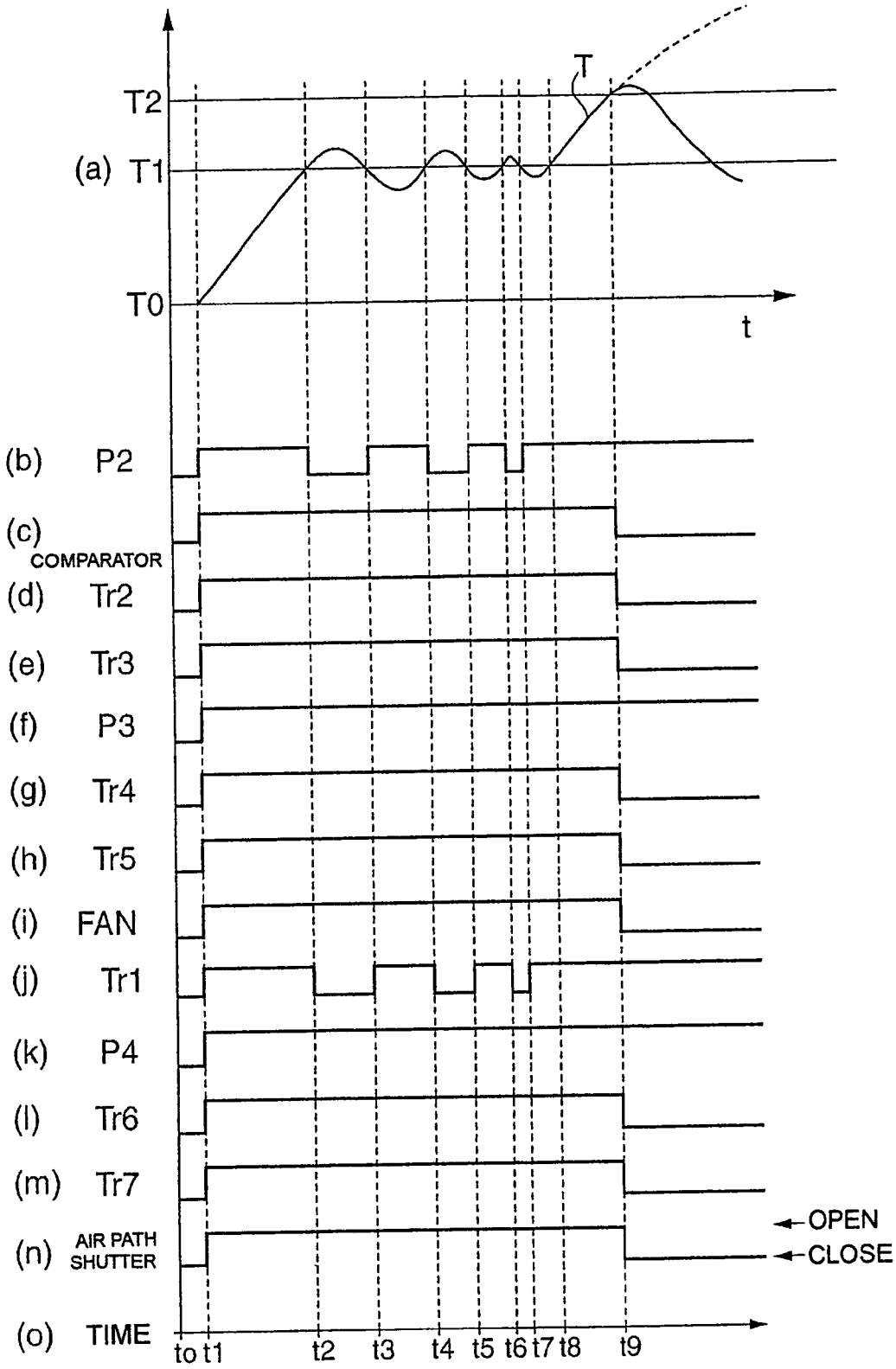
FIG. 5 is a temperature control time chart by the fixing unit of the second embodiment.

FIG. 5 is the temperature control time chart of the fixing unit according to the second embodiment, wherein (a) is the temperature detected by the thermistor 3-1 (FIG. 3), (b) the output of the port P2 (FIG. 3), (c) the output of the comparator 5-1 (FIG. 3), (d) the on/off of the transistor Tr2 (FIG. 3), (e) the on/off of the transistor Tr3 (FIG. 3), (f) the output of the port P3 (FIG. 3), (g) the on/off of the transistor Tr4 (FIG. 3), (h) the on/off of the transistor Tr5 (FIG. 3), (i) the rotation/stop of the fan 2-1 (FIG. 3), (j) the on/off of the transistor Tr1, (k) the output of the port P4, (1) the on/off of the transistor Tr6 (FIG. 3), (m) the on/off of the transistor Tr7, (n) the open/close of the air path shutter 23 (FIG. 3 or 4), and (o) the time common to all the items.

At a time t1, printing is started and the temperature control of the fixing unit is started. It is assumed that the initial value T0 of temperature detected by the thermistor 3-1 is lower than the optimum fixing temperature T1. Consequently, the voltage (corresponding to the initial value T0) at the connection point between the thermistor 3-1 and the voltage dividing resistor R1 is lower than the protective voltage (corresponding to the protective temperature) at the connection point between the voltage dividing resistors R2 and R3 so that the output of the comparator 5-1 becomes on (b), turning on the transistors Tr2 and Tr3 (d) and (e). Consequently, the resistors R7, R9, and R12 normally bias the transistors Tr1, Tr4, and Tr6 for operation.

The control section 21, which determined that the initial value T0 is lower than the optimum fixing temperature T1, turns on the port P2 to raise the temperature of the fixing roller 10 (b). This corresponds to sending out a control signal to the switching circuit 1-4. Consequently, the transistor Tr1 is turned on (j), conducting heating current in the loop consisting of the switching circuit 1-4, the heater 1-1, the thermostat 1-2, and the a-c source 1-3 so that the surface temperature of the fixing roller 10 starts to rise (a). Simultaneously, the control section 21 turns on not only the port P3 to rotate the fan 2-1 (f) but also the port P4 to open the air path shutter 23 (k).

At a time t2, the surface temperature of the fixing roller 10 exceeds the optimum fixing temperature T1. At this point, the control section 21, which has determined that the detected temperature T from the port P1 is higher than the optimum fixing temperature T1, turns off the port P2 to lower the temperature of the fixing roller 10 (b). This corresponds to the issue of a control signal to the switching circuit 104. Consequently, the transistor Tr1 is turned off (j), cutting off the loop consisting of the switching circuit 1-4, the heater 1-1, the thermostat 1-2, and the a-c source 1-3, bringing the heating current to zero (0) so that the surface temperature of the fixing roller 10 starts falling (a). At this point, the detected temperature T does not exceed the protective temperature T2 so that the items other than the port P2 (b) and the transistor Tr1 (j) keep the same conditions at the time t1.

At a time t3, the surface temperature of the fixing roller 10 falls below the optimum fixing temperature T1. The control section 21, which has determined that the detected temperature T from the port P1 is lower than the optimum fixing temperature T1, turns on the port P2 to raise the temperature of the fixing roller 10 (b). This corresponds to the issue of a control signal to the switching circuit 1-4. Consequently, the transistor Tr1 is turned on (j), conducting heating current in the loop consisting of the switching circuit 1-4, the heater 1-1, the thermostat 1-2, and the a-c source 1-3, so that the surface temperature of the fixing roller starts to rise (a).

In subsequent period between t4 and t7, it continues the similar operation to control the temperature of the fixing roller 10.

At a time t8, the surface temperature of the fixing roller 10 exceeds the optimum fixing temperature T1. The control section 21, which has determined that the detected temperature T from the port P1 is higher than the optimum fixing temperature T1, is supposed to turn off the port P2 to lower the temperature of the fixing roller 10, but it is assumed that the "on" state continues for a failure of the control section 21 or the switching circuit 1-4 (b). Consequently, the heating current continues to flow so that the surface temperature of the fixing roller 10 continues to rise and exceeds the protective temperature T2 at a time t9.

Consequently, the voltage at the connection point between the thermistor 3-1 and the voltage dividing resistor R1 becomes higher than the protective voltage at the connection point between the voltage dividing resistors R2 and R3 so that the comparator 5-1 is turned off (b), turning off the transistors Tr2 and Tr3 (d) and (e). Consequently, the resistors R7 and R9 shit the bias point to such an extent that the transistors Tr4 and Tr6 become inoperable. As a result, not only the heating current becomes zero (0) regardless of the outputs of the port P2 (b), P3 (f), and P4 (k) but also the fan 2-1 is stopped (i) and the air path shutter 23 is closed.

As described above, if the fixing roller 10 is heated up above the protective temperature T2, the supply of heating current to the heater 1-1 is stopped, the rotation of the fan 2-1 is stopped, and the air path shutter 23 is closed regardless of the control by the control section 21. Since not only the fan 2-1 is stopped but also the air path shutter is closed, the raised temperature is prevented to spread over the entire unit, causing a malfunction. In addition, even if the fan 2-1 is not stopped due to an abnormality of the driving circuit of the cooling section, the raised temperature is prevented to spread over the entire unit.

Alternatively, the solenoid 23-3 and the shutter member 23-1 may be replaced by any mechanism capable of opening/closing the air path between the fixing roller 10 and the fan 2-1. If the air path has a rectangular section, the air path is closed by a rectangular shutter member that is rotatable 90 degrees to open the air path.

Third Embodiment

Figure 6:
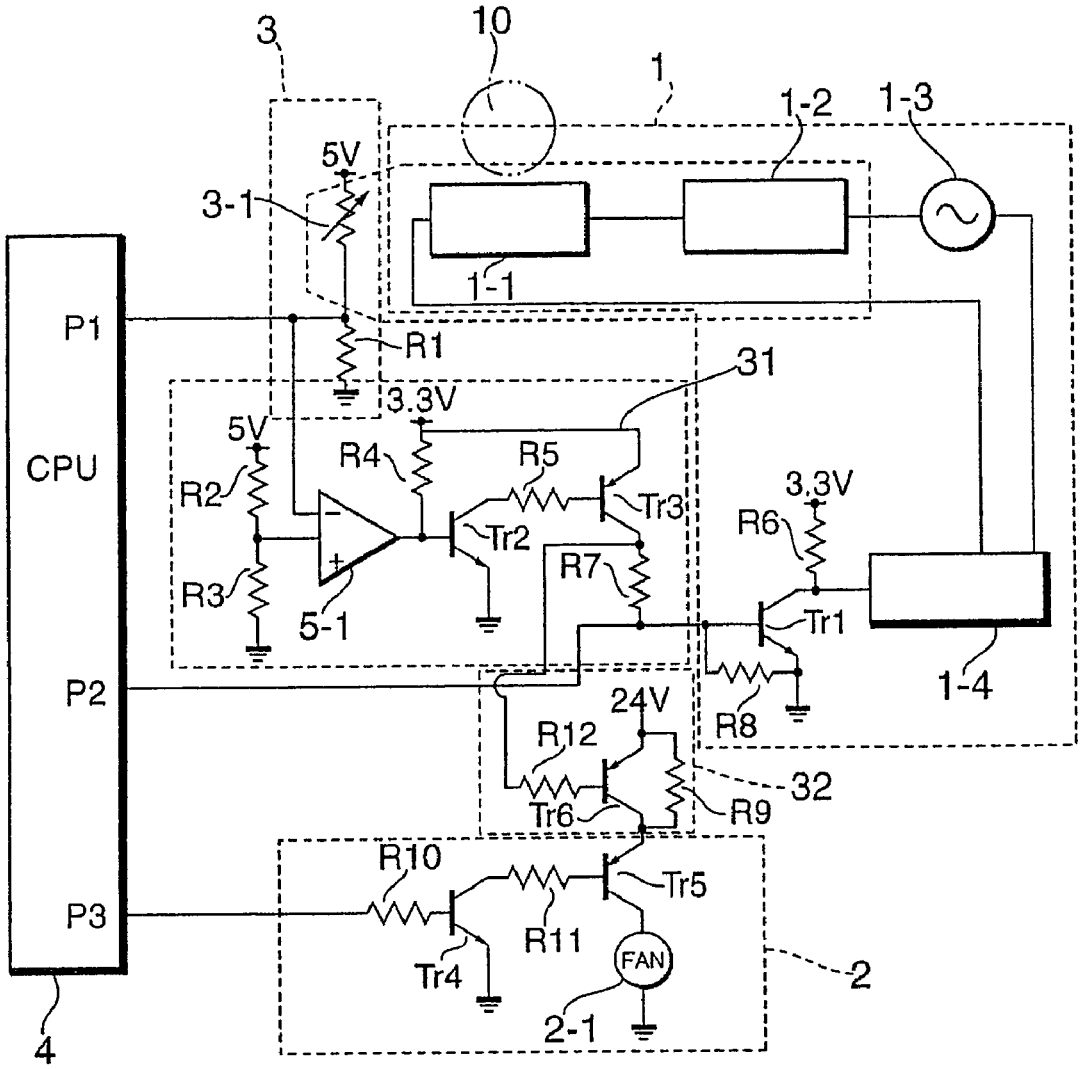
FIG. 6 is a circuit diagram of a fixing unit according to the third embodiment of the invention.

FIG. 6 shows the temperature control circuit for the fixing unit which includes the heating section 1, the cooling section 2, the temperature detection section 3, the control section 4, a heating current cutoff section 31, and a cooling current reducing section 32. Only those different from the first embodiment will be described and the components identical with those of the first embodiment are given the same reference numbers as those of the first embodiment.

The heating current cutoff section 31 cuts off current conduction to the heating section 1 regardless of control of the control section 4 if the temperature detected by the temperature detection section 3 exceeds a predetermined temperature (protective temperature). It includes the voltage dividing resistors R2 and R3, and a pulse forming circuit consisting of the comparator 5-1, the transistors Tr2 and Tr3, and the resistors R4, R5, and R7.

The positive terminal of the comparator 5-1 is provided with the protective voltage to avoid an abnormal temperature increase in the fixing roller 10. The protective voltage is defined by the ratio of the voltage dividing resistors R2 and R3. The output terminal of the comparator 5-1 is connected to not only the base of the transistor Tr2 but also the 3.3 Vd-c voltage source via the resistor R4. The emitter of the transistor Tr2 is grounded and the collector is connected to the base of the transistor Tr3 via the resistor R5. The emitter and collector of the transistor Tr3 are connected to the 3.3 Vd-c source and the base of the transistor Tr1 via the resistor R7, respectively. The collector of the transistor Tr3 is connected to the base of the transistor Tr6 for the cooling current reducing section 32 via the resistor R12.

The cooling current reducing section 32 reduces the cooling current flowing through the fan 2-1 of the cooling section 2 if the temperature detected by the temperature detection section 3 exceeds the protective temperature T2, making the heating current cutoff section 31 cut off the current conduction to the heating section 1. It includes the transistor Tr6, the resistor R12 connecting the base of the transistor Tr6 and the collector of the transistor Tr3, and the resistor R9 connecting the collector and emitter of the transistor Tr6. The emitter and collector of the transistor Tr6 are connected to the 24 Vd-c source and the emitter of the transistor Tr5 for supplying cooling current to the fan 2-1, respectively.

Until the temperature detected by the temperature detection section 3 exceeds the protective temperature, the transistor Tr3 is on so that the transistor Tr6 is on. At this point, the cooling current to the fan 2-1 is supplied from the 24 Vd-c source to the transistor Tr5 via the transistor Tr6. When the temperature detected by the temperature detection section 3 exceeds the protective temperature, the transistor Tr3 is turned off, which in turn turns off the transistor Tr6. Consequently, the cooling current for the fan 2-1 is supplied from the 24 Vd-c source to the transistor Tr5 via the resistor R9. That is, the cooling current is reduced to decrease the number of rotations of the fan 2-1, resulting in the reduced amount of air.

Figure 7:
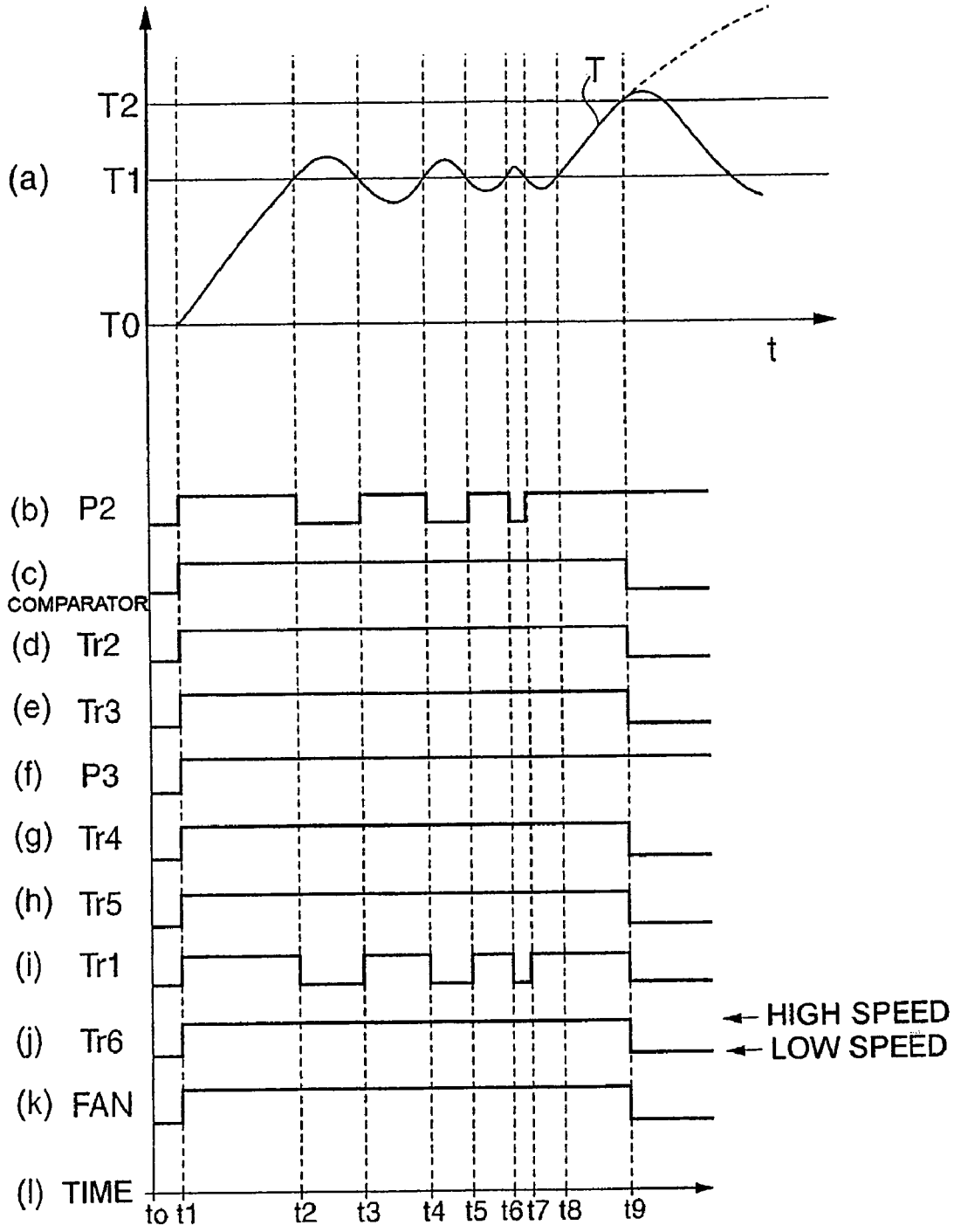
FIG. 7 is a temperature control time chart by the fixing unit of the third embodiment.
Figure 8:
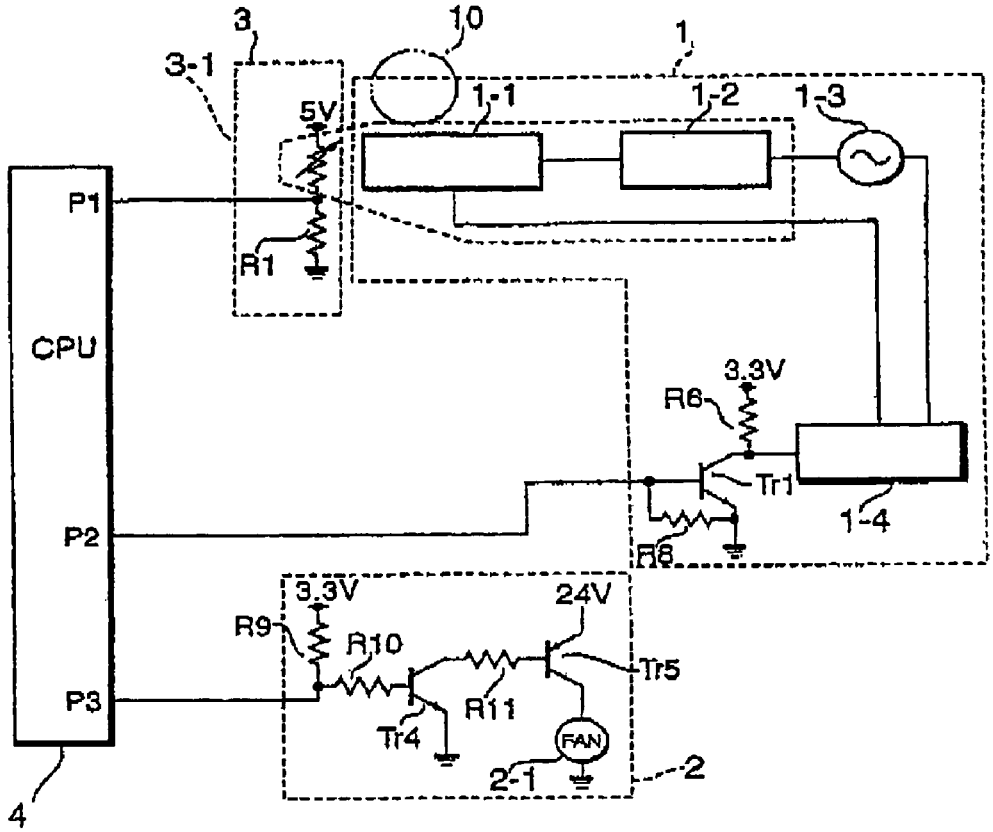
FIG. 8 PRIOR ART
FIG. 8 is a circuit diagram of a conventional fixing unit.

FIG. 7 shows the temperature control by the fixing unit according to the third embodiment, wherein (a) is the temperature detected by the thermistor 3-1 (FIG. 6), (b) the output of the port P2 (FIG. 6), (c) the output of the comparator 5-1 (FIG. 6), (d) the on/off of the transistor Tr2 (FIG. 6), (e) the on/off of the transistor Tr3 (FIG. 6), (f) the output of the port P3 (FIG. 6), (g) the on/off of the transistor Tr4 (FIG. 6), (h) the on/off of the transistor Tr5 (FIG. 6), (i) the on/off of the transistor Tr1 (FIG. 6), (j) the on/off of the transistor Tr6 (FIG. 6), (k) the number of rotations of the fan 2-1, and (l) the time common to all the items.

At a time t1, printing is started and the temperature control of the fixing unit is started. It is assumed that the initial value T0 of temperature detected by the thermistor 3-1 is lower than the optimum fixing temperature T1. Consequently, the voltage (corresponding to the initial value T0) at the connection point between the thermistor 3-1 and the voltage dividing resistor R1 is lower than the protective voltage (corresponding to the protective temperature T2) at the connection point between the voltage dividing resistors R2 and R3 so that the output of the comparator 5-1 becomes on (b), turning on the transistors Tr2 and Tr3 (d) and (e). Consequently, the resistors R7 and R9 make the transistors Tr1 and Tr6 normally biased for operation.

The control section 4 (FIG. 6), which has determined that the initial value T0 is lower than the optimum fixing temperature T1, turns on the port P2 to raise the temperature of the fixing roller 10 (FIG. 6) (b). This corresponds to the issue a control signal to the switching circuit 1-4. Consequently, the transistor Tr1 is turned on (i), conducting heating current in a loop consisting of the switching circuit 1-4, the heater 1-1, the thermostat 1-2, and the a-c source 1-3 so that the surface temperature of the fixing roller 10 starts rising (a). Simultaneously, the control section 4 turns on the port P3 to rotate the fan 2-1 (f).

At a time t2, the surface temperature of the fixing roller 10 exceeds the optimum fixing temperature T1. At this point, the control section 4, which has determined that the detected temperature T from the port P1 is higher than the optimum fixing temperature T1, turns off the port P2 to lower the temperature of the fixing roller 10 (b). This corresponds to the issue of a control signal to the switching circuit 1-4. Consequently, the transistor Tr1 is turned off (i), cutting off the loop consisting of the switching circuit 1-4, the heater 1-1, the thermostat 1-2, and the a-c current source 1-3, bringing the heating current to zero (0) so that the surface temperature of the fixing roller 10 starts to fall (a). At this point, the detected temperature T does not exceed the protective temperature T2 so that the items other than the port P2 (b) and the transistor Tr1 (i) keep the same conditions at the time t1.

At a time t3, the surface temperature of the fixing roller 10 falls below the optimum fixing temperature T1. The control section 4, which has determined that the detected temperature T from the port P1 is lower than the optimum fixing temperature T1, turns on the port P2 to raise the temperature of the fixing roller 10 (b). This corresponds to the issue of a control signal to the switching circuit 1-4. Consequently, the transistor Tr1 is turned on (i), conducting heating current in the loop consisting of the switching circuit 1-4, the heater 1-1, the thermostat 1-2, and the a-c current source 1-3, so that the surface temperature of the fixing roller starts rising (a).

In subsequent period between t4 to t7, it continues the similar operation to control the temperature of the fixing roller 10.

At a time t8, the surface temperature of the fixing roller 10 exceeds the optimum fixing temperature T1. The control section 4, which has determined that the detected temperature T from the port P1 is higher than the optimum fixing temperature T1, is supposed to turn off the port P2 to lower the temperature of the fixing roller 10, but it is assumed that the on state continues for a failure of the control section 4 or the switching circuit 1-4 (b). Consequently, the heating current continues to flow so that the surface temperature of the fixing roller 10 continues to rise and exceeds the protective temperature T2 at a time t9.

Consequently, the voltage at the connection point between the thermistor 3-1 and the voltage dividing resistor R1 becomes higher than the protective voltage T2 at the connection point between the voltage dividing resistors R2 and R3 so that the comparator 5-1 is turned off (b), turning off the transistors Tr2 and Tr3 (d) and (e). Consequently, the resistors R7 and R12 shit the bias point to such an extent that the transistors Tr1 and Tr6 become inoperable. As a result, the heating current becomes zero (0) regardless of the output of the port P2 (b). The cooling current for the fan 2-1 is supplied to the transistor Tr5 from the 24 Vd-c source to the transistor Tr5 via the resistor R9 regardless of the output of Port P3 (f). That is, the cooling current is reduced to decrease the number of rotations of the fan 2-1, resulting in the reduced amount of air blown.

As described above, if the fixing roller 10 is heated up above the protective temperature T2, not only the supply of heating current to the heater 1-1 is stopped but also the number of rotations of the fan 2-1 is reduced regardless of the control by the control section 4. For a certain type of the fixing unit, it is better to reduced the number of rotations of the fan 2-1 to an appropriate number than to stop the rotation of the fan 2-1 for minimizing the occurrence of a malfunction.

Figure 9:
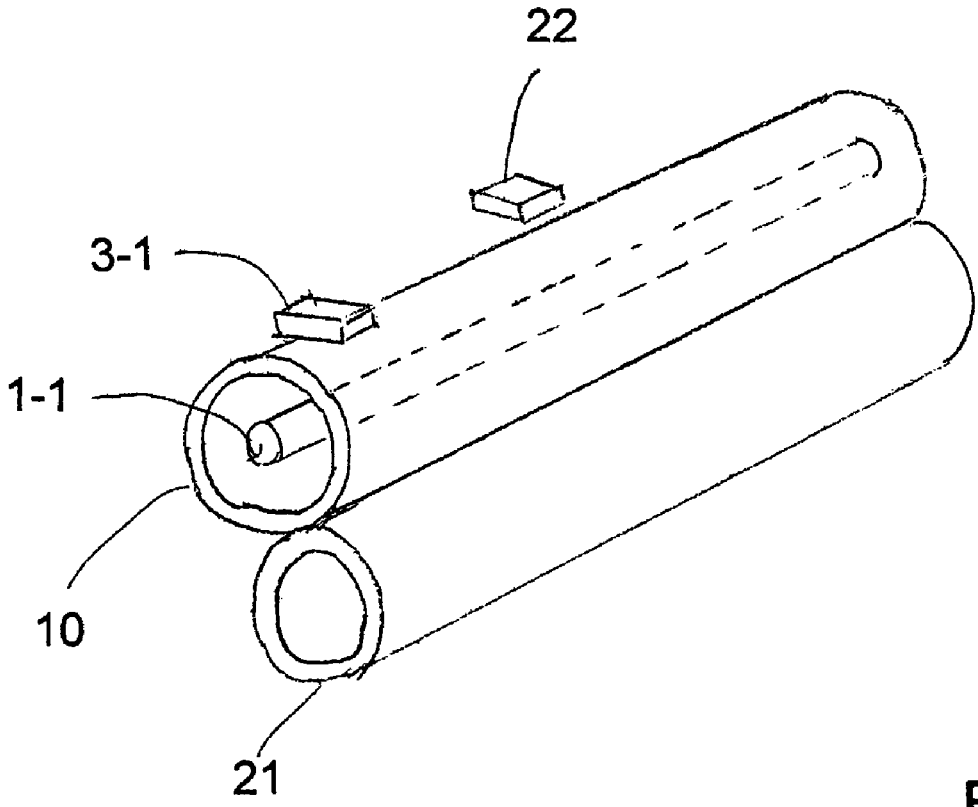
FIG. 9 is a perspective view of a fixing unit.

In FIG. 9, the fixing unit includes the fixing roller 10 rotatably supported by a frame (not shown) and a pressure roller 21 which is rotated by a driving device (not shown) in contact with the fixing roller 10 under pressure. The fixing roller 10 has a three-layer structure made by coating a tubular core of aluminum or the like with a heat resistant, elastic layer of silicone rubber or the like to a thickness of 1–2 mm, then a release layer of Teflon (trade name) or the like to a thickness of 30 μm, and finally an elastic layer of silicone rubber or the like to a thickness of 70 μm. The heater 1-1 made of a halogen lamp or the like is provided within the tubular core to heat the fixing roller 10 by heat conduction.

The pressure roller 21 is made by coating a tubular core of aluminum or stainless steel with a release layer of Teflon, such as PFT or ETFE, to a thickness of 3–100 μm. The pressure roller 21 has no elastic layer and is made very hard and the fixing roller 10 is provided with a relatively thick elastic layer so as to form a press contact section (nip section) between the pressure and fixing rollers 21 and 10.

The thermistor 3-1 is provided in contact with the fixing roller 10 to detect the surface temperature of the fixing roller 10. Based on the temperature detected by the thermistor 3-1, the control section 4 controls current conduction to the heater 1-1 to keep the fixing roller 10 at a predetermined surface temperature. A thermostat 22 is provided at a predetermined distance from the fixing roller 10 to cut off current conduction to the heater 1-1 if the fixing roller 10 is heated up abnormally.

Figure 10:
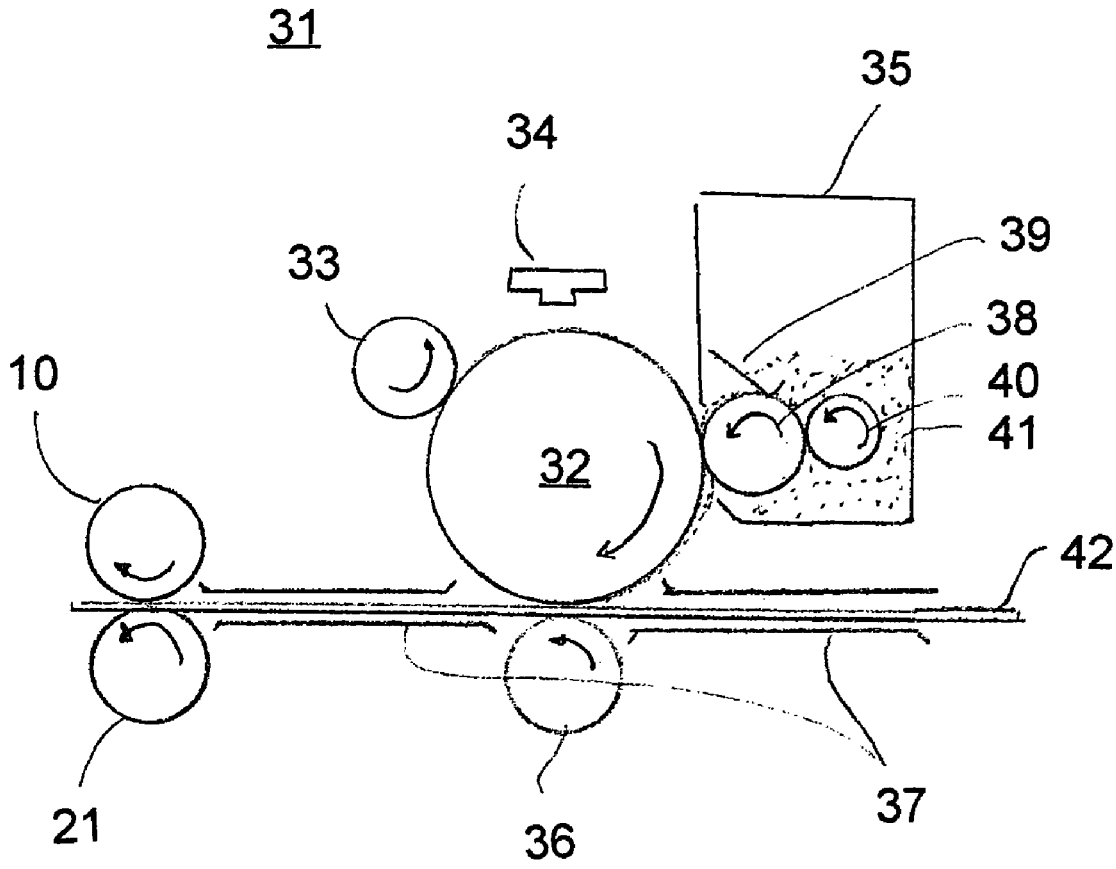
FIG. 10 is a side view of an image forming apparatus.

In FIG. 10, an image forming apparatus 31 includes an electrostatic latent image carrier or photosensitive drum 32, a charging unit 33, an exposure unit 34, a developing unit 35, and a transfer unit 36. The fixing unit is provided on the downstream of a medium transporting path 37 which runs through an abutment section between the photosensitive drum 32 and the transfer unit 36.

The charging unit 33 applies a high negative voltage to the charging roller to provide the surface of the photosensitive drum 32 with a uniform negative charge. The exposure unit 34 turns on a light emitting element according to the printing data to bring the charged surface to approximately zero (0) V to form an electrostatic latent image.

The developing unit 35 includes a developing roller 38, a developing blade 39, a toner transport roller 40, and a developer or toner 41 and applies a high negative voltage lower than the voltage on the surface of the photosensitive drum 32 to the developing roller 38 and the developing blade 39 to provide the toner 41 with a negative charge and the developing roller with a thin layer, respectively.

Where the developing roller 38 is of the contact type, the roller surface is made of a smooth rubber roller whereas for the non-contact type or the magnetic developing system, for example, the roller surface is not necessarily a rubber layer. The toner transport roller 40 is made of a sponge roller.

The transfer unit 36 applies a high positive voltage to a transfer roller to provide a positive charge for the printing medium transported along the medium transport path 37. The fixing unit fuses the toner onto the printing medium 42 when the printing medium with the transferred toner passes through the nip section between the rollers 10 and 21.

The photosensitive drum 32, the charging roller 33, the developing roller 38, the toner transport roller 40, the fixing roller 10, and the pressure roller 21 are rotated in the directions of arrows by motors (not shown) which are controlled by an image forming and control unit (not shown).

In operation, when the image forming and control unit receives a print command and print data from an upper device (not shown), it rotates the photosensitive drum 32, the charging roller 33, the developing roller 38, the toner transport roller 40, the fixing roller 10, and the pressure roller 21 in the respective directions.

Then, the image forming and control unit applies a high negative voltage to the charging roller 33 via the charging unit to provide the surface of the photosensitive drum 32 with a uniform negative charge, turns on the light emitting element via the exposure unit, forming an electrostatic latent image on the photosensitive drum 32. Then, it applies a high negative voltage to the developing roller 38 and the toner transport roller 40 via the developing unit to provide the toner 41 with a negative charge so that the toner 41 adheres to the electrostatic latent image by electrostatic effects for making development.

Then, it supplies the transfer roller 36 with a high positive voltage via the transfer unit to provide the print medium 42 on the medium transporting path 37 with a positive charge. The developed toner image is then transferred to the print medium 42 from the photosensitive drum 32. The toner image transferred to the print medium 42 is passed through the nip section between the pressure roller 21 and the fixing roller 10 that is heated by the control section 4 for fusion. The print medium 42, on which the toner image has been fixed, is discharged into an outside stacker (not shown).

The invention claimed is:

1. A fixing unit comprising:

a heating section for heating a heating member;

a cooling section for cooling an interior of said fixing unit;

a temperature detecting section for detecting a temperature of said heating member;

a control section for controlling current conduction to said heating section based on said temperature detected by said temperature detecting section; and a conduction cutoff section for cutting off said current conduction to said heating section independently of current control by said control section if said detected temperature exceeds a predetermined temperature.

2. The fixing unit according to claim 1, wherein said heating section comprises a heater and a first driving circuit for driving said heater;

said cooling section comprises a cooling fan and a second driving circuit for driving said cooling fan; and said conduction cutoff section comprises a comparison circuit for comparing an output of said temperature detecting section and a predetermined voltage to output a signal to stop said driving of said heater and said cooling fan by said first and second driving circuits, respectively.

3. The fixing unit according to claim 2, wherein said control section controls said first and second driving circuits, respectively.

4. The fixing unit according to claim 3, further comprising a cutoff element provided in vicinity of said heating section and a current source for supplying current via said cutoff element.

5. The fixing unit according to claim 1, wherein said control section controls current conduction to said heating section and said cooling section through software and said conduction cutoff section cuts off current conduction to said heating section and said cooling section by a hardware circuit.

6. The fixing unit according to claim 5, wherein said conduction cutoff section cuts off current conduction to said heating and cooling sections even if said control section tends to conduct current to said heating and cooling sections.

7. The fixing unit according to claim 1, which further comprises an air quantity reducing section for reducing an amount of air blown into said unit interior if said detected temperature exceeds said predetermined temperature.

8. A fixing unit comprising:

a heating section for heating a heating member;

a cooling section for cooling a unit interior of said fixing unit;

a temperature detecting section for detecting a temperature of said heating member;

a control section for controlling current conduction to said heating section based on said temperature detected by said temperature detecting section;

a conduction cutoff section for cutting off current conduction to said heating section independently of conduction control by said control section if said detected temperature exceeds a predetermined temperature; and an air quantity reducing section for reducing an amount of air blown by said cooling section if said detected temperature exceeds said predetermined temperature.

9. The fixing unit according to claim 8, wherein said cooling section comprises a cooling fan; and said air quantity reducing section reduces a rotation speed of said cooling fan.

10. The fixing unit according to claim 9, wherein said cooling section comprises a driving circuit for supplying electric current to said cooling fan;

a current reducing section for reducing said electric current to said cooling fan; and said air quantity reducing section operates said current reducing section to reduce said rotation speed of said cooling fan.

11. The fixing unit according to claim 8, wherein said control section controls current conduction to said heating and cooling sections through software;

said conduction cutoff section cuts off said current conduction to said heating section through a hardware circuit; and said air quantity reducing section reduces said air amount blown by said cooling section.

12. An image forming apparatus comprising:

an electrostatic latent image carrier;

a charging section for charging a surface of said electrostatic latent image carrier;

an exposing section for exposing said charged electrostatic latent image carrier to form an electrostatic latent image;

a developing section for making toner adhere to said electrostatic latent image to form a toner image;

a transfer section for transferring said toner image onto a print medium;

a heating section for heating a heating member to fix said transferred toner image on said print medium;

a cooling section for cooling an interior of said image forming apparatus;

a temperature detecting section for detecting a temperature of said heating member;

a control section for controlling current conduction to said heating section based on said detected temperature; and a conduction cutoff section for cutting off said current conduction to said heating and cooling sections independently of said conduction control by said control section if said detected temperature exceeds a predetermined temperature.

13. The image forming apparatus according to claim 12, wherein said heating section comprises a heater and a first driving circuit for driving said heater;

said cooling section comprises a cooling fan and a second driving circuit for driving said cooling fan; and said conduction cutoff section comprises a comparison circuit for comparing an output of said temperature detecting section and a predetermined voltage to output a signal for terminating said driving by said first and second driving circuits.

14. The image forming apparatus according to claim 13, wherein said control section controls independently said first and second driving circuits of said heating and cooling sections.

15. The image forming apparatus according to claim 14, further comprising a shutter member provided in vicinity of said heating member and a current supply for supplying electric current via said shutter member.

16. The image forming apparatus according to claim 12, wherein said control section controls current conduction to said heating and cooling sections through software and said conduction cutoff section cuts off current conduction to said heating and cooling sections through a hardware circuit.

17. The image forming apparatus according to claim 16, wherein said conduction cutoff section cuts off current conduction to said heating and cooling sections even if said control section tends to conduct current to said heating and cooling sections.

18. The image forming apparatus according to claim 12, which further comprises an air quantity reducing section for reducing an amount of air blown into said apparatus interior if said detected temperature exceeds a predetermined temperature.

19. An image forming apparatus comprising:

an electrostatic latent image carrier;

a charging section for charging a surface of said electrostatic latent image carrier;

an exposing section for exposing said charged electrostatic latent image carrier to form an electrostatic latent image;

a developing section for adhering a toner to said electrostatic latent image to form a toner image;

a transfer section for transferring said toner image onto a print medium;

a heating section for heating a heating member to fix said transferred toner image on said print medium;

a cooling section for cooling an interior of said apparatus;

a temperature detecting section for detecting a temperature of said heating member;

a control section for controlling current conduction to said heating section based on said detected temperature;

a conduction cutoff section for cutting off said current conduction to said heating and cooling sections independently of said conduction control by said control section if said detected temperature exceeds a predetermined temperature; and an air quantity reducing section for reducing an amount of air blown by said cooling section if said detected temperature exceeds a predetermined temperature.

20. The image forming apparatus according to claim 19, wherein said cooling section comprises a cooling fan and said air quantity reducing section reduces a rotation speed of said fan.

21. The image forming apparatus according to claim 20, wherein said cooling section comprises a driving circuit for supplying electric current to said cooling fan and a current reducing section for reducing electric current to said cooling fan via said driving circuit, and said air quantity reducing section operates said current reducing section to reduce a rotation speed of said cooling fan.

22. The image forming apparatus according to claim 19, wherein said control section controls current conduction to said heating and cooling sections through software and said conduction cutoff section cuts off current conduction to said heating section through a first hardware circuit and said air quantity reducing section reduces an amount of air by said cooling section through a second hardware circuit.

* * * * *